US010556656B2

(12) United States Patent
Kuntz

(10) Patent No.: US 10,556,656 B2
(45) Date of Patent: Feb. 11, 2020

(54) WATERCRAFT PADDLE APPARATUS

(71) Applicant: Carl Kuntz, Waterloo (CA)

(72) Inventor: Carl Kuntz, Waterloo (CA)

( * ) Notice: Subject to any disclaimer, the term of this patent is extended or adjusted under 35 U.S.C. 154(b) by 0 days.

(21) Appl. No.: 16/109,419

(22) Filed: Aug. 22, 2018

(65) Prior Publication Data

US 2019/0061896 A1 Feb. 28, 2019

Related U.S. Application Data

(60) Provisional application No. 62/550,075, filed on Aug. 25, 2017.

(51) Int. Cl.

| | |
|---|---|
| ***B63H 16/18*** | (2006.01) |
| ***B63H 25/02*** | (2006.01) |
| ***B63H 25/06*** | (2006.01) |
| ***B63H 1/32*** | (2006.01) |

(52) U.S. Cl.

CPC ..... *B63H 16/18* (2013.01); *B63H 1/32* (2013.01); *B63H 25/02* (2013.01); *B63H 25/06* (2013.01); *B63H 2025/022* (2013.01); *B63H 2025/024* (2013.01)

(58) Field of Classification Search

CPC ..... B63H 16/18; B63H 25/02; B63H 25/06; B63H 2025/022; B63H 2025/024

See application file for complete search history.

(56) References Cited

U.S. PATENT DOCUMENTS 5,194,023 A * 3/1993 Stone ..... B63H 16/08 440/20

10,124,869 B1 * 11/2018 Bailey ..... B63H 16/08

* cited by examiner

*Primary Examiner* — Stephen P Avila

(74) *Attorney, Agent, or Firm* — Bereskin & Parr LLP

(57) ABSTRACT

There is disclosed a watercraft paddle apparatus operable by a user's legs and feet. In an embodiment, the watercraft paddle apparatus comprises a pair of rails positioned side-by-side and mountable to a watercraft, each rail configured to slidably receive a pedal mechanism adapted to slide back and forth along each rail. Each pedal mechanism includes a downwardly extendable paddle adapted to engage a water surface on which the watercraft is floating during a backward stride and to lift from the water surface on a forward stride, whereby a user can operate the pedal mechanism in each rail using an alternating walking or skiing motion. In an embodiment, each pedal mechanism is supported laterally by a front axle with a pair of wheels on either end of the front axle engaging the parallel rails. In another embodiment, each pedal mechanism is attached.

16 Claims, 16 Drawing Sheets

WATERCRAFT PADDLE APPARATUS

FIELD OF THE INVENTION

The present invention relates generally to a watercraft paddle apparatus, and more particularly to a watercraft paddle apparatus operable by a user's legs and feet.

BACKGROUND

Various types of watercraft are operable using a user's legs and feet, including the ubiquitous paddleboat operated by one or more users using a bicycle pedaling motion while in a seated position. While functional for its purpose in moving the paddleboat forward, operating the pedals in a seated position provides a very limited range of motion utilizing only certain muscles in the user's legs, therefore quickly inducing muscle fatigue. Furthermore, remaining in a seated position may cause undue pressure on a user's backside, exacerbating the fatigue and discomfort experienced by the user.

What is therefore needed is an improved design for moving watercraft with a user's legs and feet.

SUMMARY

The present invention relates to a watercraft paddle apparatus operable by a user's legs and feet while in a standing position, using a walking motion or a cross country skiing motion.

In an aspect, the watercraft paddle apparatus comprises a pair of pedals, with each pedal slidingly engaging parallel rails to allow an alternating walking or cross country skiing motion. Each pedal has a downwardly extending paddle attached to a front portion of each pedal, with the downwardly extending paddle adapted to engage the surface of the water on which the watercraft is floating.

In an embodiment, each pedal is supported laterally by a front axle with a pair of wheels on either end of the front axle engaging the parallel rails. The pedal is adapted to pivot about the front axle in a front to back rocking motion between parallel rails. Each pedal is also attached, via a bendable knee bracket, to a rear axle with a pair of wheels on either end of the rear axle engaging the same parallel rails as the front axle. The bendable knee bracket allows each pedal to be angled through a range of motion in order to support a user's foot throughout a front to back stride, and back again to the front again.

The rotatable joint of the bendable knee bracket is positioned towards the rear of the pedal, and may extend beyond the rear of the pedal as may be necessary to provide support through a full range of motion.

In an embodiment, the bendable knee bracket includes a resilient tensile spring secured on either side of the joint and bent around the outside of the rotatable joint, thereby acting to extend the bendable knee when the spring is not under an external load.

In an embodiment, a pair of correspondingly configured pedals each slidingly engage parallel rails which are positioned side-by-side, in order to allow a smooth, alternating, walking or cross country skiing motion.

In use, the downwardly extending paddles mounted to the front of the pedals engage the water underneath the user's feet, and propels the watercraft forward with each backward push on a pedal by a user's legs and feet. While one pedal is pushing back on one side, the other pedal on the other side is being returned to a forward position, without the paddle substantially engaging the water, in order to prepare for the next stride pushing back the pedal from the other side.

In an illustrative embodiment, the watercraft comprises a pair of elongate pontoons with cross brackets securing the pontoons together. The cross brackets are used to mount the pair of parallel rails positioned side-by-side, with each parallel rail including a sliding pedal mechanism.

Advantageously, as the user is able to use a full range of motion of the user's legs and feet in order to push the watercraft forward, the user is less likely to experience fatigue in any particular muscle area. As well, the longer strides permitted by this apparatus allows the watercraft to be pushed forward more efficiently.

In this respect, before explaining at least one embodiment of the invention in detail, it is to be understood that the invention is not limited in its applications to the details of construction and to the arrangements of the components set forth in the following description or the examples provided therein, or illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION

As noted above, the present invention relates to a watercraft paddle apparatus operable by a user's legs and feet while in a standing position, using a walking motion or a cross country skiing motion.

An illustrative example will now be shown and described with reference to the drawings.

Figure 1:
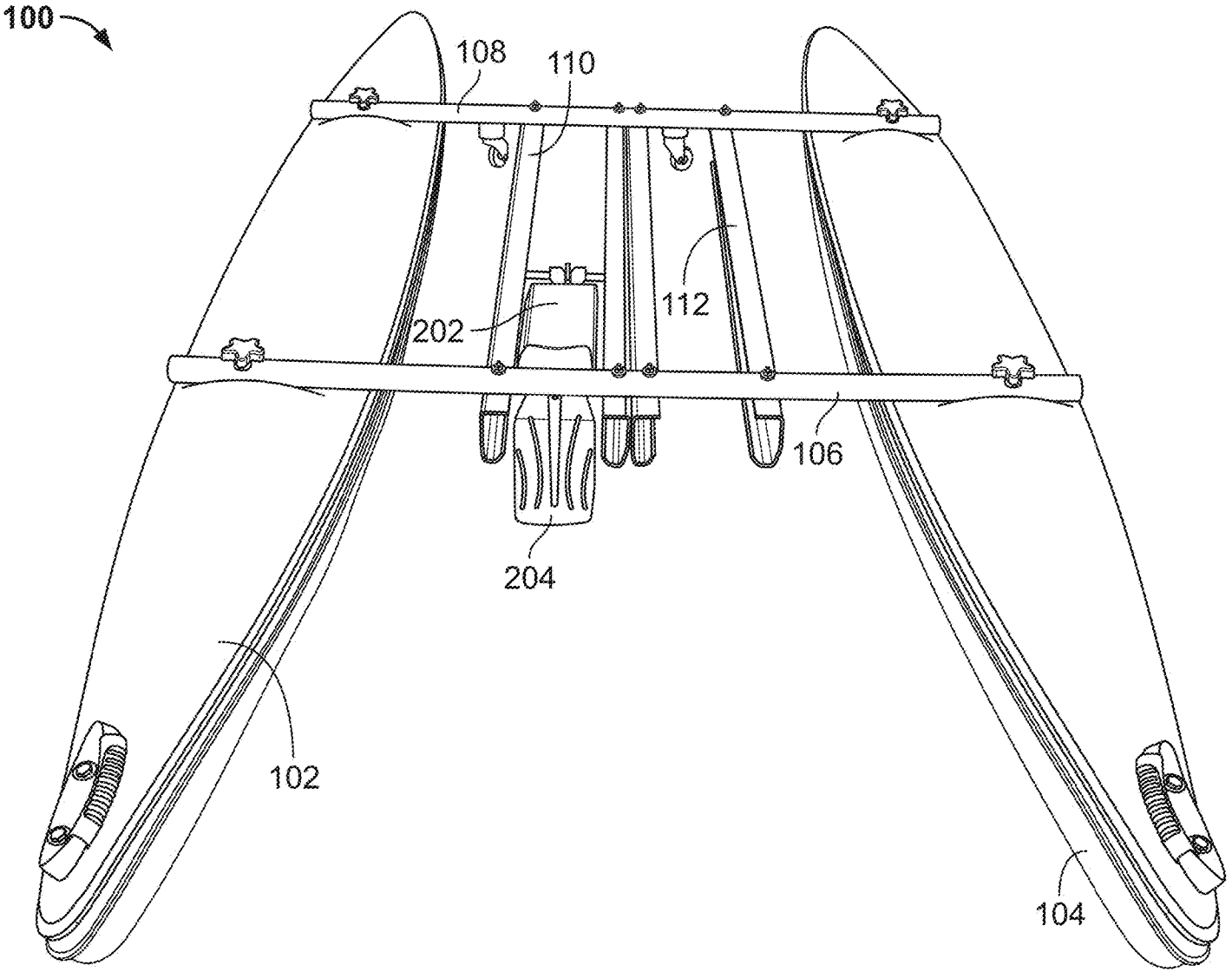
FIG. 1 shows a photograph of an illustrative watercraft comprising a pair of pontoons with a pair of parallel rails mounted on cross brackets perpendicular to the pair pontoons in accordance with an embodiment.

As shown in FIG. 1, in an illustrative embodiment, watercraft 100 comprises a pair of elongate pontoons 102, 104 with cross brackets 106, 108 securing the pontoons 102, 104 together. The cross brackets 106, 108 are used to mount a pair of parallel rails 110, 112, positioned side-by-side with each parallel rail 110, 112 including a sliding pedal mechanism 200 (see FIG. 2) including a pedal 202 and a downwardly extending paddle 204.

Each pedal mechanism 200 slidingly engages the parallel rails 110, 112 to allow a user to use an alternating walking or cross country skiing motion. A downwardly extending paddle 204 is attached to a front portion of each pedal 202, with the downwardly extending paddle 204 adapted to engage the surface of the water on which the watercraft 100 is floating.

In an embodiment, each pedal 202 is supported laterally by a front axle 212 (see FIG. 9, and FIGS. 10A and 10B) with a pair of wheels on either end of the front axle 212 engaging the parallel rails 110, 112. The pedal 202 is adapted to pivot about the front axle 212 in a front to back rocking motion between the parallel rails 110, 112. The parallel rails 110, 112 are positioned side-by-side a comfortable width apart, in order to allow a smooth, alternating, walking or cross country skiing motion in use.

As shown further below in FIG. 21, a vertical support bar with handles may be mounted to the front cross bracket 106 to provide a user with a stabilizing support during operation of the watercraft 100. Optionally, the vertical support bar may be rotatable from left to right, similar to the handle bars of a bicycle. A rudder may extend downwardly from the vertical support bar to steer the watercraft 100 in a desired direction.

Figure 2:
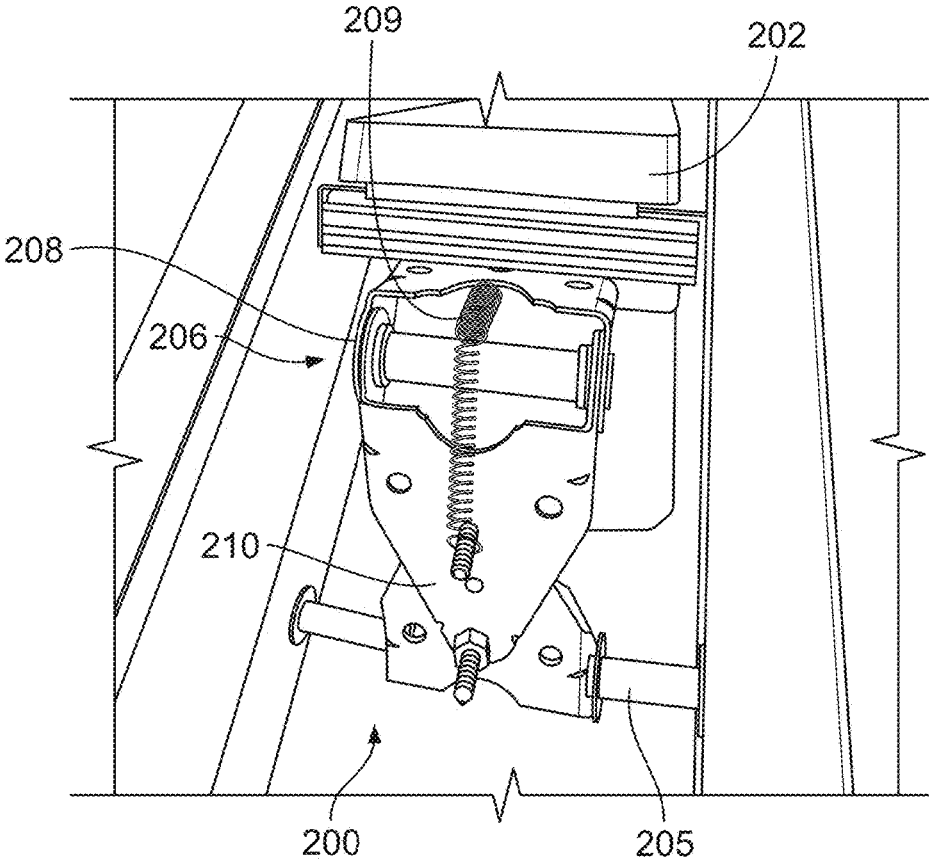
FIG. 2 shows a detailed view of an illustrative pedal mechanism including a bendable knee bracket in accordance with an illustrative embodiment.

Now referring to FIG. 2, shown is an illustrative pedal mechanism 200 with a pedal 202 mounted to a rear axle 205 via a bendable knee bracket 206. The bendable knee bracket 206 allows each pedal 202 to be angled through a full range of motion in order to support a user's foot throughout a front to back stride, and back again to the front again.

In this illustrative embodiment, a rotatable joint 208 of the bendable knee bracket 206 is located behind the rear of the pedal 202, and includes a lower limb 210 which is sufficiently long to allow the full range of motion.

In an embodiment, the bendable knee bracket 206 includes a resilient tensile spring 209 secured on either side of the rotatable joint 208 and bent around the outside of the rotatable joint 208, thereby acting to extend the bendable knee when the spring 209 is not under an external tensile load.

Figure 3:
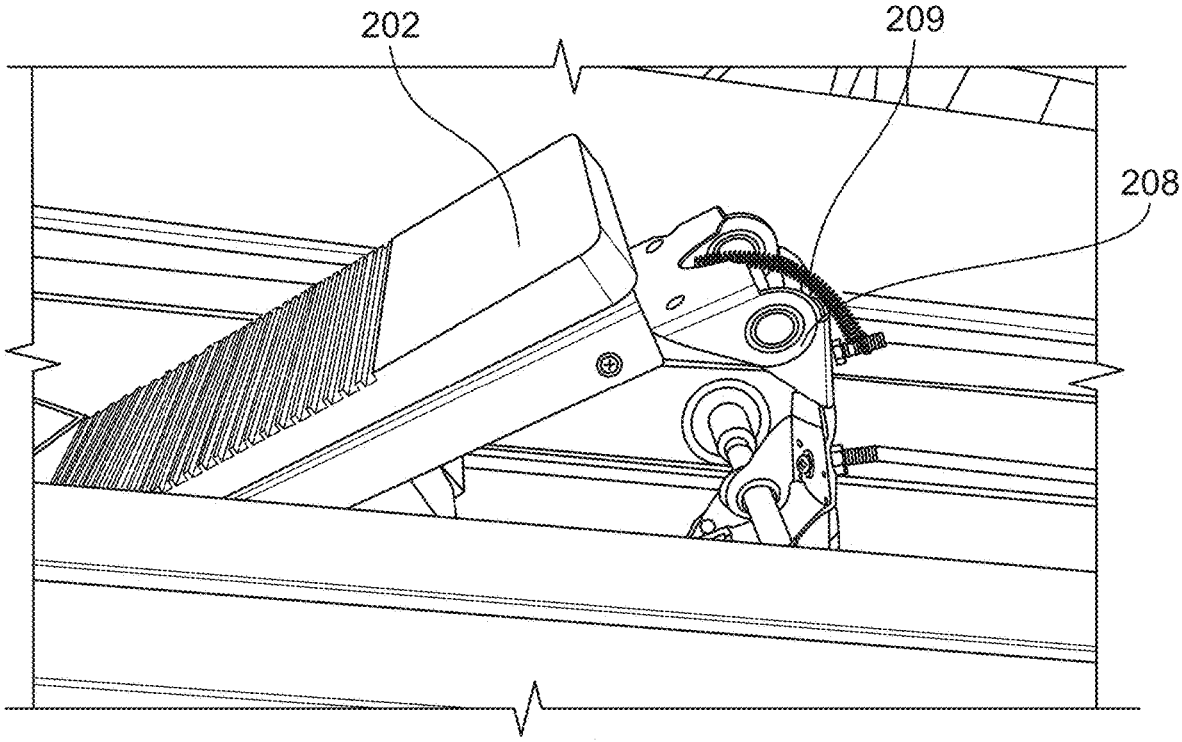
FIG. 3 shows a detailed side view of a rear portion of the pedal mechanism and the bendable knee bracket of FIG. 2.
Figure 4:
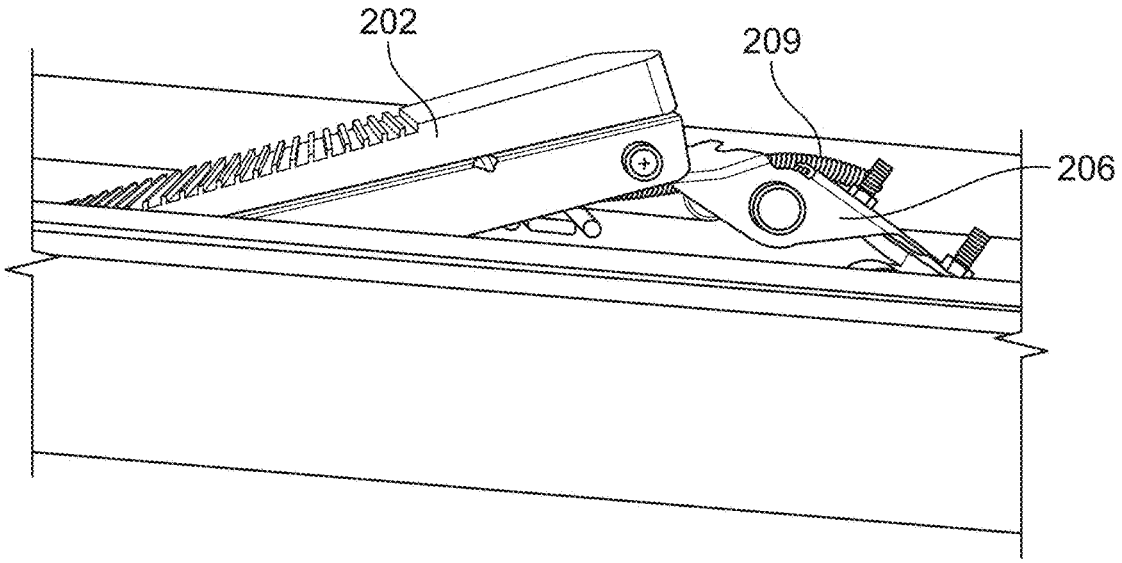
FIG. 4 shows a detailed side view of the bendable knee bracket of FIG. 2 in an extended position.

FIG. 3 shows a corresponding side view of the pedal mechanism 200 with rotatable joint 208, spring 209, and pedal 202. FIG. 4 shows the pedal mechanism 200 in a more extended position, with pedal 202 now forming an obtuse angle relative to the bendable knee bracket 206. Spring 209 is under less tensile load in this position than in the sharper angle shown in FIG. 3.

Figure 5:
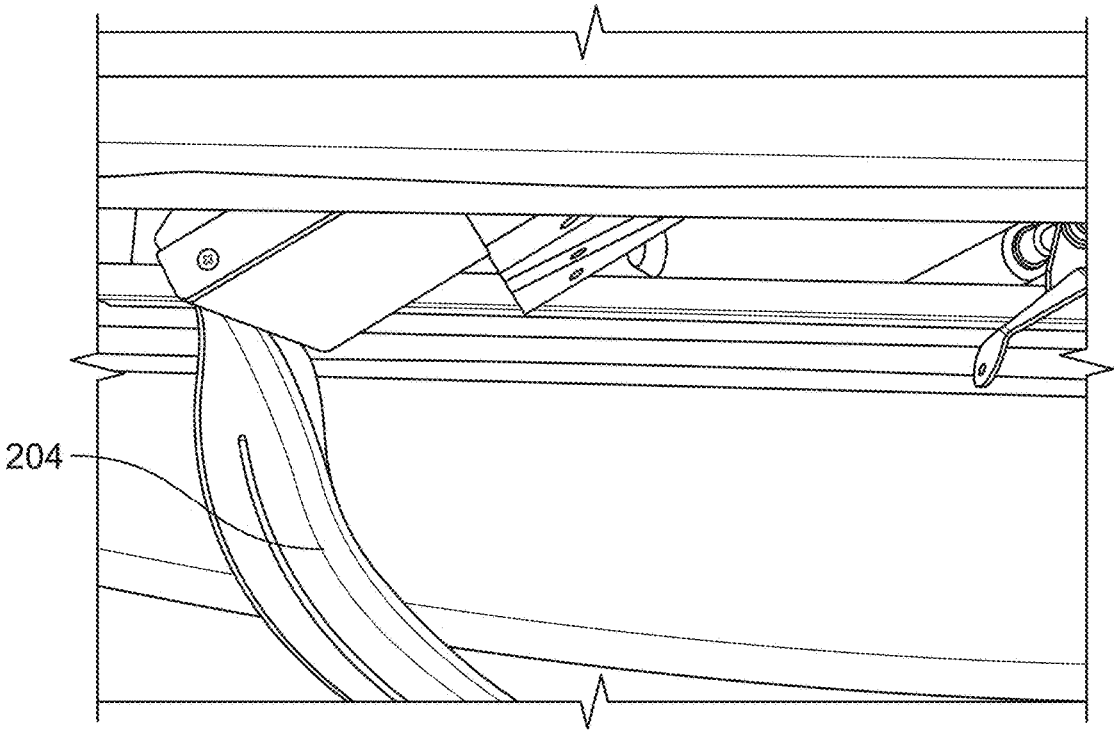
FIG. 5 shows a detailed side view of a downwardly extending paddle mounted to a front portion of a pedal.
Figure 6:
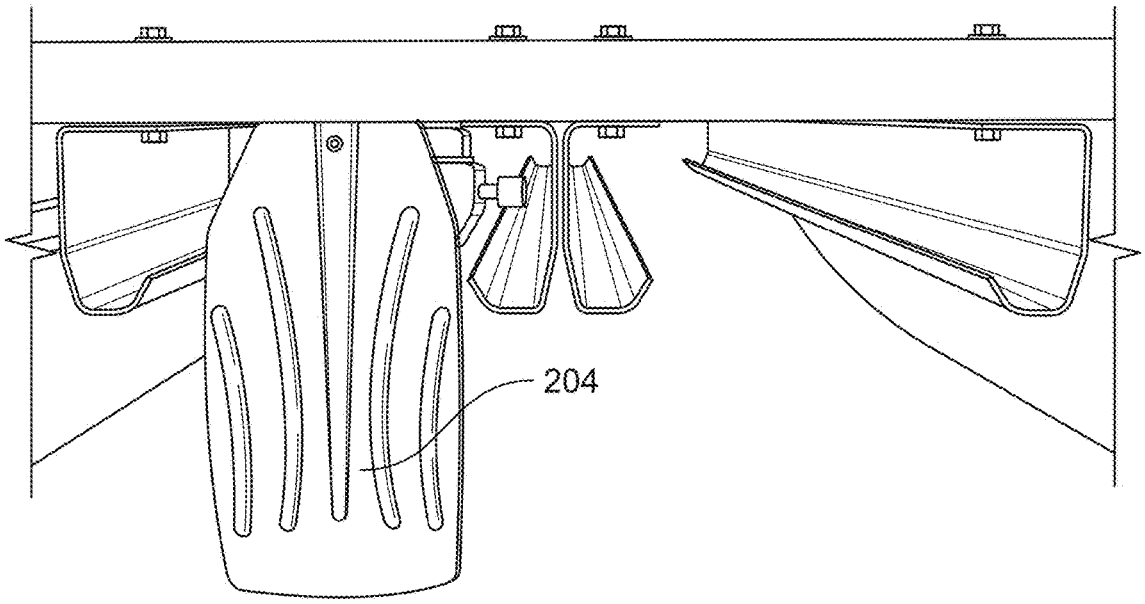
FIG. 6 shows a detailed front view of the downwardly extending paddle of FIG. 5.
Figure 7:
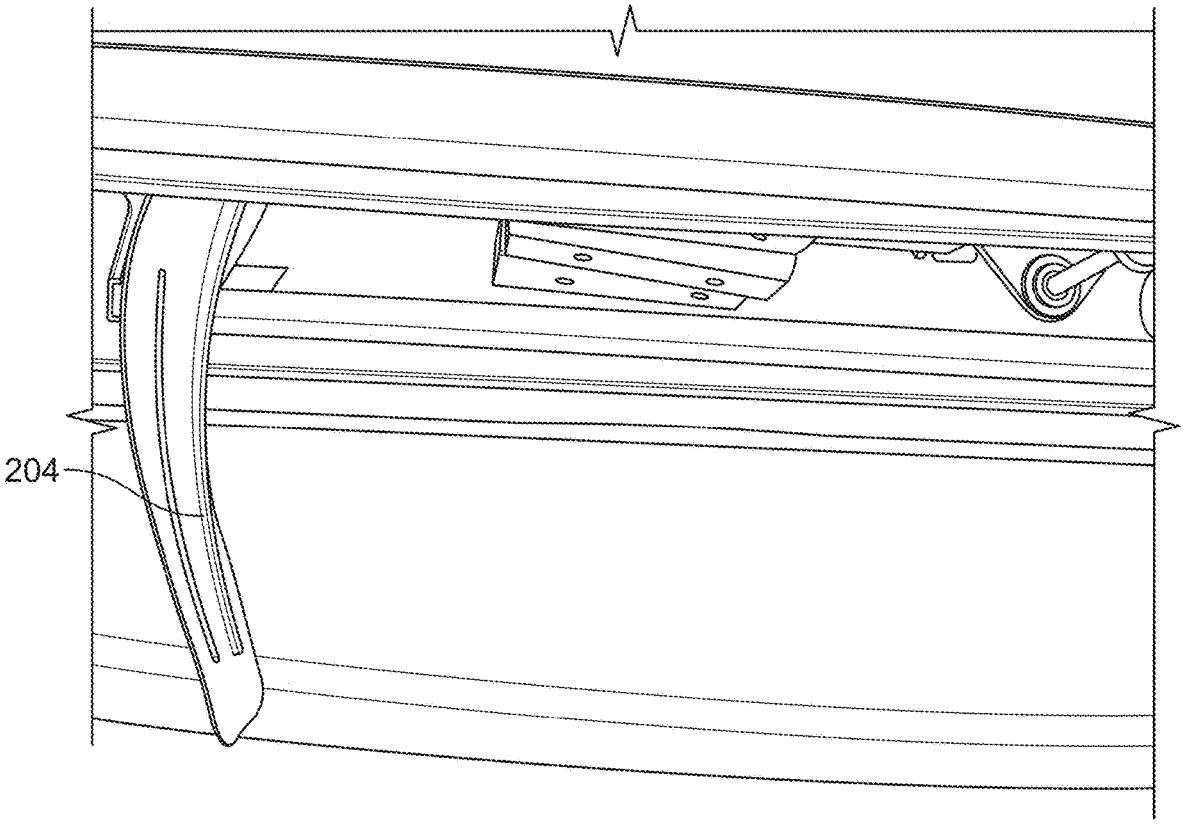
FIG. 7 shows a detailed side view of the downwardly extending paddle of FIG. 5 in a more upright position.

FIGS. 5-7 show the downwardly extending paddle 204 from various different angles. In an embodiment, as shown, the paddle 204 forms a generally curved scoop shape to allow the paddle to efficiently push back against the water with each stride or stroke. By changing the angle formed by the pedal 202, it will be appreciated that the angle of attack of the paddle 204 will also change.

Still referring to FIGS. 5-7, the paddle 204 may be attached to the pedal 202 by a spring loaded hinge which allows the paddle 204 to fully extend for a backward stroke or slide, but close at least partially for a forward stroke or slide. Alternatively, the paddle 204 may be flexible to bend for the forward stroke or slide, but extend for the forward stroke or slide.

For either the hinged embodiment or the flexible paddle 204, a foot or toe button or actuator may be spring loaded on pedal 202. This may allow the user to push down on the button or actuator to engage the paddle 204 fully, so that the user can use it for reversing backwards, or to maneuver in tight areas. While the paddle 204 may be mounted directly to the peddle 202 without these additional features, it would make the watercraft 100 less maneuverable.

Figure 8:
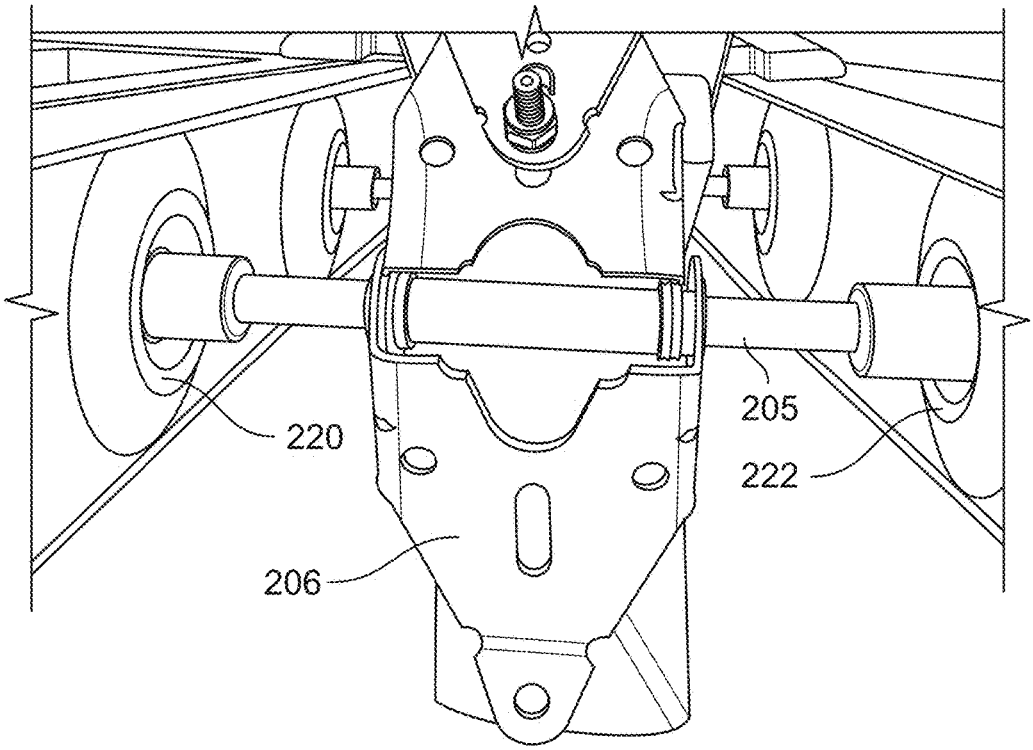
FIG. 8 shows a detailed view of the bendable knee bracket of FIG. 2 mounted on a rear axle.

Now referring to FIG. 8, shown is a detailed view of the bendable knee bracket 206, further showing how the bendable knee bracket 206 is rotatably mounted to the rear axle 205. As shown in this view, wheels 220, 222 mounted on either end of the rear axle 205 travel back and forth along a channel formed within each parallel rail 110, 112.

Figure 9:
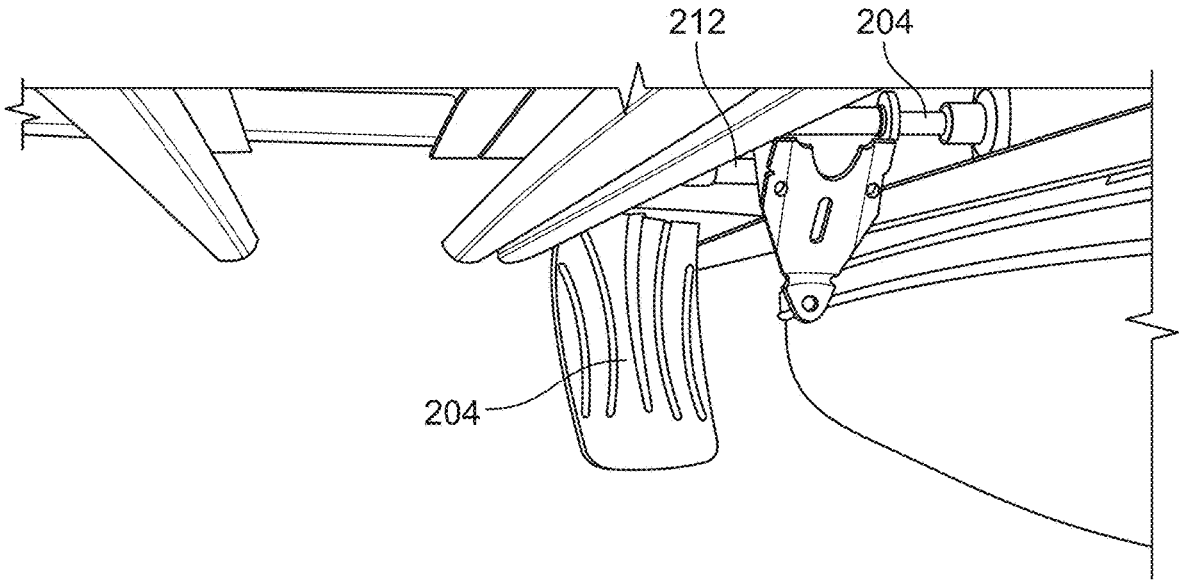
FIG. 9 shows a bottom view of the pair of parallel rails with an illustrative pedal mechanism mounted on the right parallel rails.

FIG. 9 shows a bottom view of the pair of parallel rails 110, 112, with an illustrative pedal mechanism mounted on the right parallel rails. This view also shows the front axle 212 and the rear axle 205 both keeping the pedal mechanism within the parallel rail 110, 112.

Figure 10A:
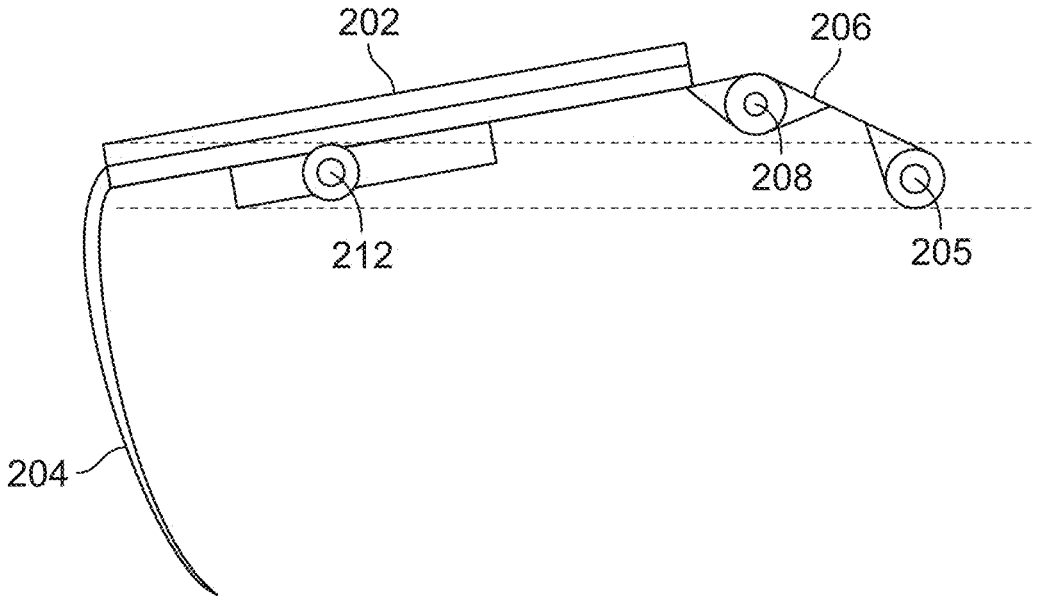
FIGS. 10A and 10B show a schematic side view of a pedal with front and rear axles mounted on wheels engaging a track surface shown as a dotted line, with various angles the pedal can form by bending the rotatable knee bracket.
Figure 10B:
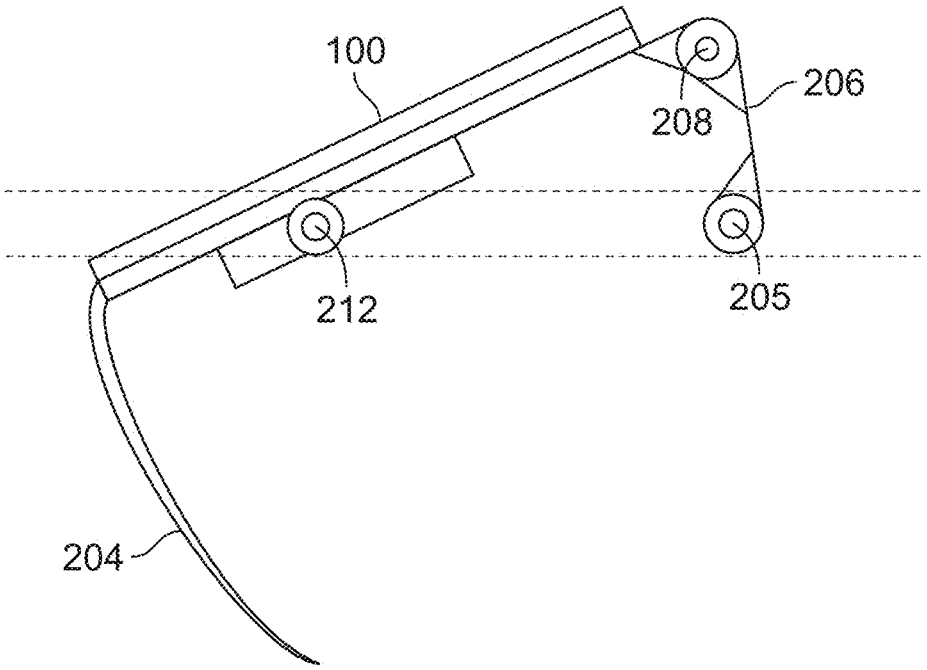

Now referring to FIGS. 10A and 10B, shown is a schematic side view of a pedal mechanism with front and rear axles 212, 205 mounted on wheels engaging a bottom track surface of the parallel rails 110, 112, shown schematically as a dotted line. As shown, the bendable knee bracket 205 allows the pedal 202 to form various angles by bending the rotatable knee bracket 206 at the joint 208.

Figure 11A:
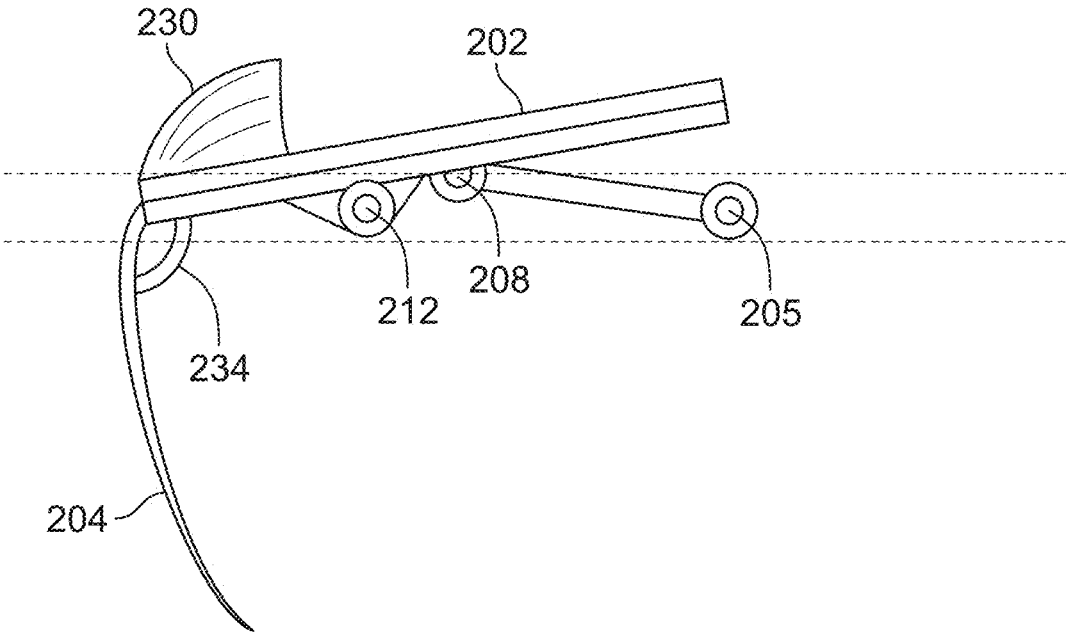
FIGS. 11A and 11B show a schematic side view of an alternative embodiment of a pedal with front and rear axles mounted on wheels engaging a track surface shown as a dotted line, with various angles the pedal can form by the pedal.
Figure 11B:
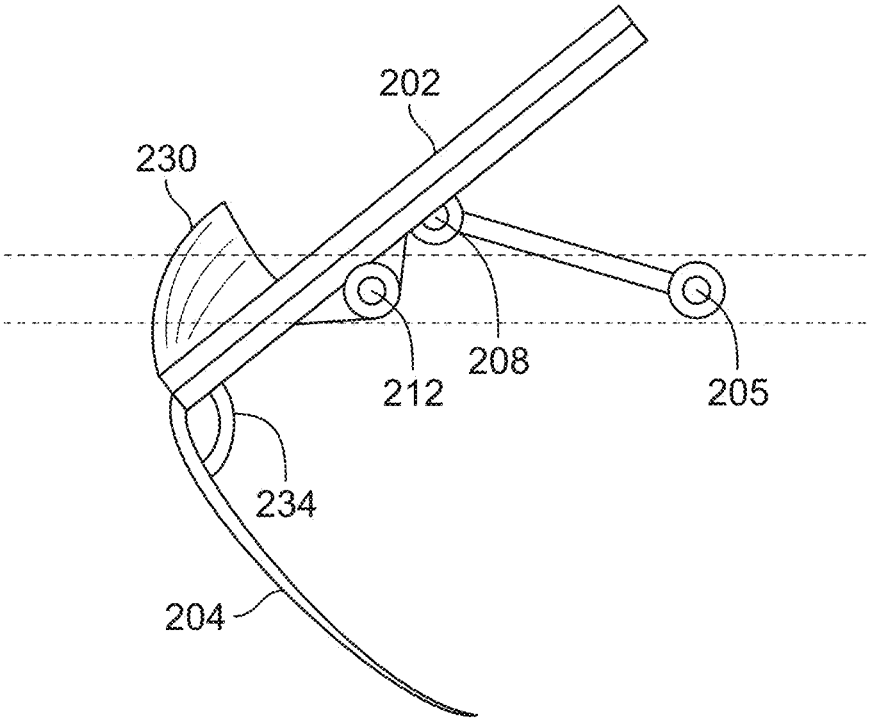

FIGS. 11A and 11B show an alternative embodiment of the pedal mechanism in which the location of the rotatable joint 208 is moved forward underneath the pedal 202 and closer to the front axle 212 than the rear axle 205. The rotatable joint 208 may be spring loaded to help the pedal 202 return to a flatter position during a return stroke to the front. This alternative embodiment allows the pedal 202 to be angled forward at the joint 208 at a greater angle than is possible in the embodiment shown in FIGS. 10A and 10B, as shown in FIG. 11B. In order to allow a user to maintain contact with the pedal 202 at these steeper angles, a foot cradle 230 is provided at the front of the pedal 202 to stop the user's foot from sliding forward. If desired, a suitable strap mechanism may be used to securely strap in the user's feet on both pedals 202.

Still referring to FIGS. 11A and 11B, in this embodiment, actuator 234 may be actuated to lower the paddle 204 into position, or to lift the paddle 204 such that the paddle 204 does not engage any water surface during a return stroke to the front. This actuator may be coupled, for example, to a foot switch, toe switch, or lever for manual operation, or may otherwise be adapted to operate automatically during a stroke cycle.

In use, the downwardly extending paddles 204 mounted to the front of the pedals 202 engage the water underneath the user's feet, and propels the watercraft 100 forward with each backward push on a pedal by a user's legs and feet. While one pedal is pushing back on one side, the other pedal on the other side is being returned to a forward position, without the paddle substantially engaging the water, in order to prepare for the next stride pushing back the pedal from the other side. The watercraft 100 may be steered in a desired direction by turning the handles or wheels of a vertical support bar mounted to the front cross bracket 106, to operate a rudder or steering fin extending below into the water.

Figure 12:
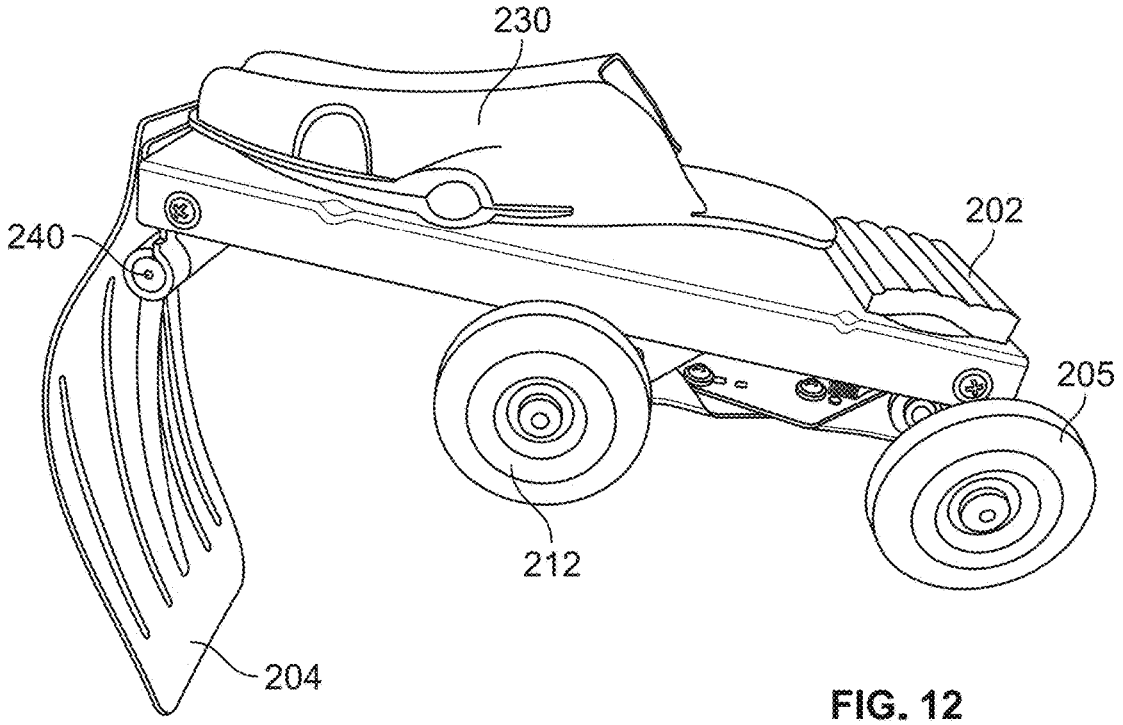
FIGS. 12 to 14 show detailed views of a pedal mechanism in accordance with another embodiment.
Figure 13:
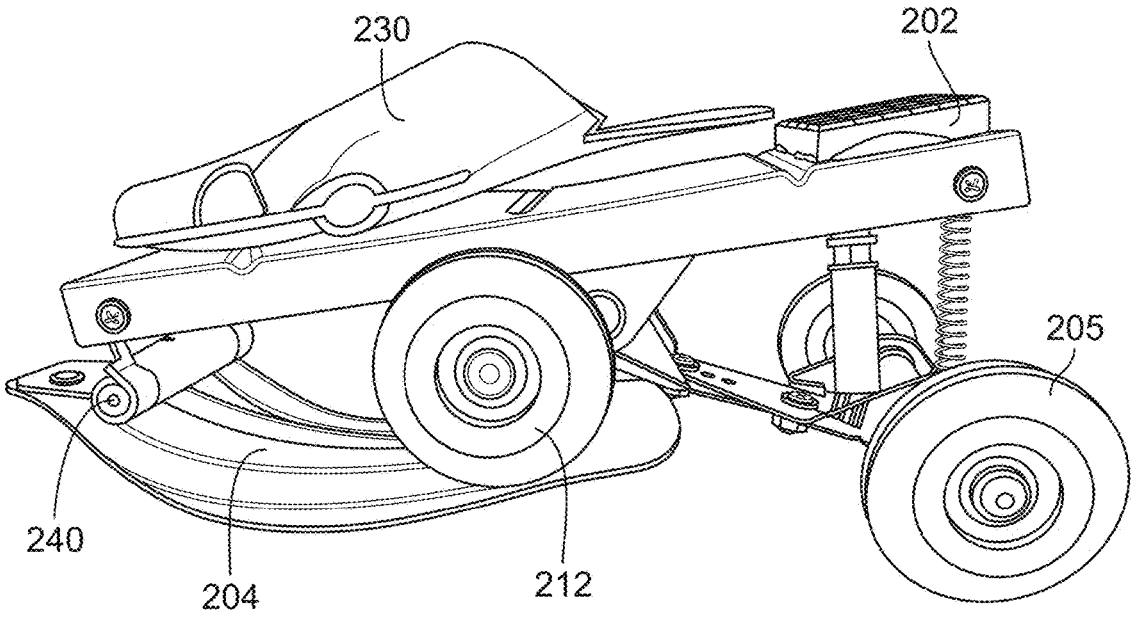
Figure 14:
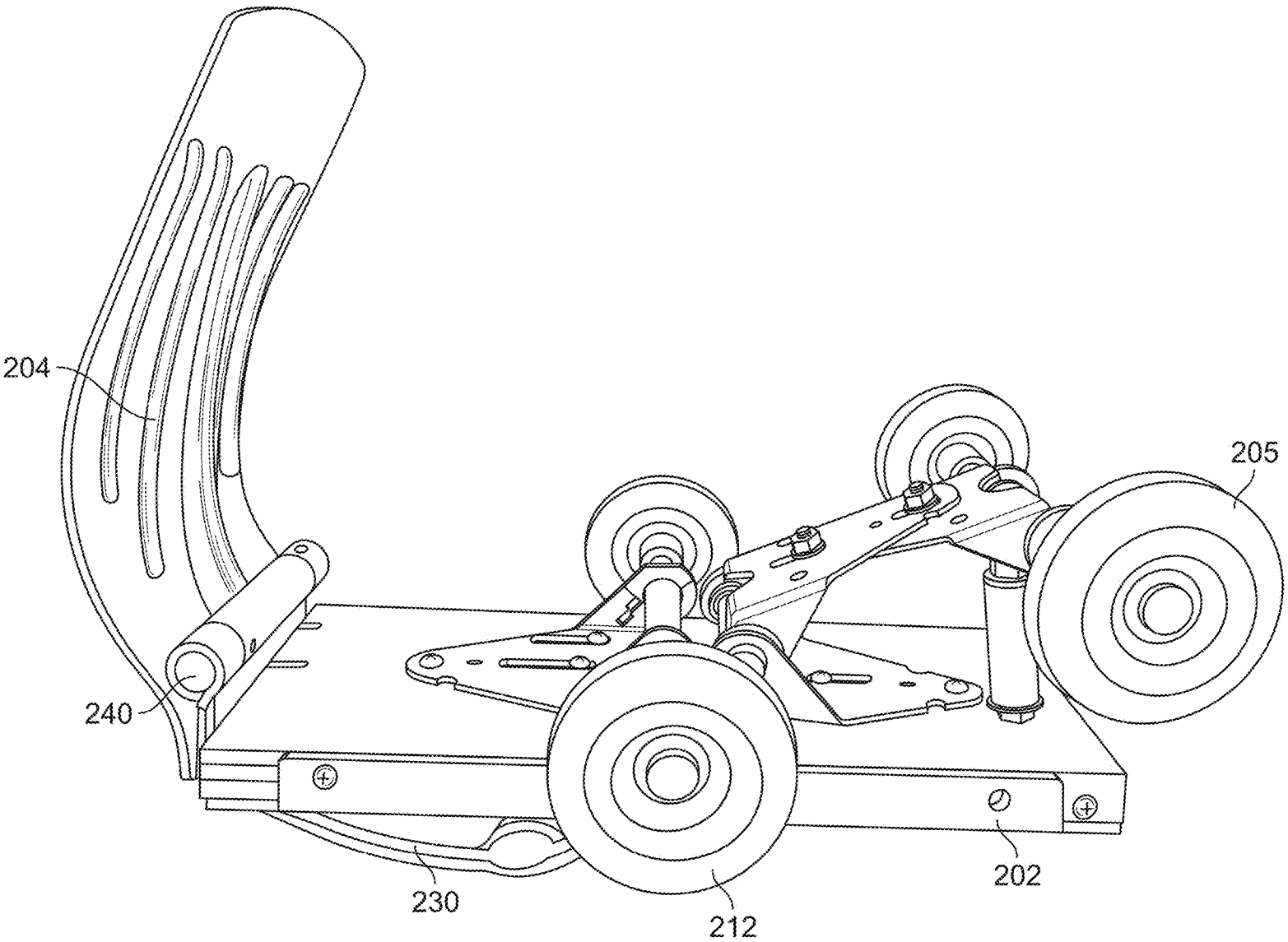

Now referring to FIGS. 12 to 14, shown are detailed views of a pedal mechanism in accordance with another embodiment. In this embodiment, the downwardly extending paddle 204 is mounted to the front of the pedal 202 at a hinge 240, which holds the paddle 204 in a substantially upright position on a backward stride as shown in FIG. 12, but which allows the paddle 204 to collapse on a return forward stride as shown in FIG. 13. FIG. 14 shows the hinge 240 more clearly, and also shows how paddle 204 is stopped and held in a substantially upright position on a backward stride.

Figure 15B:
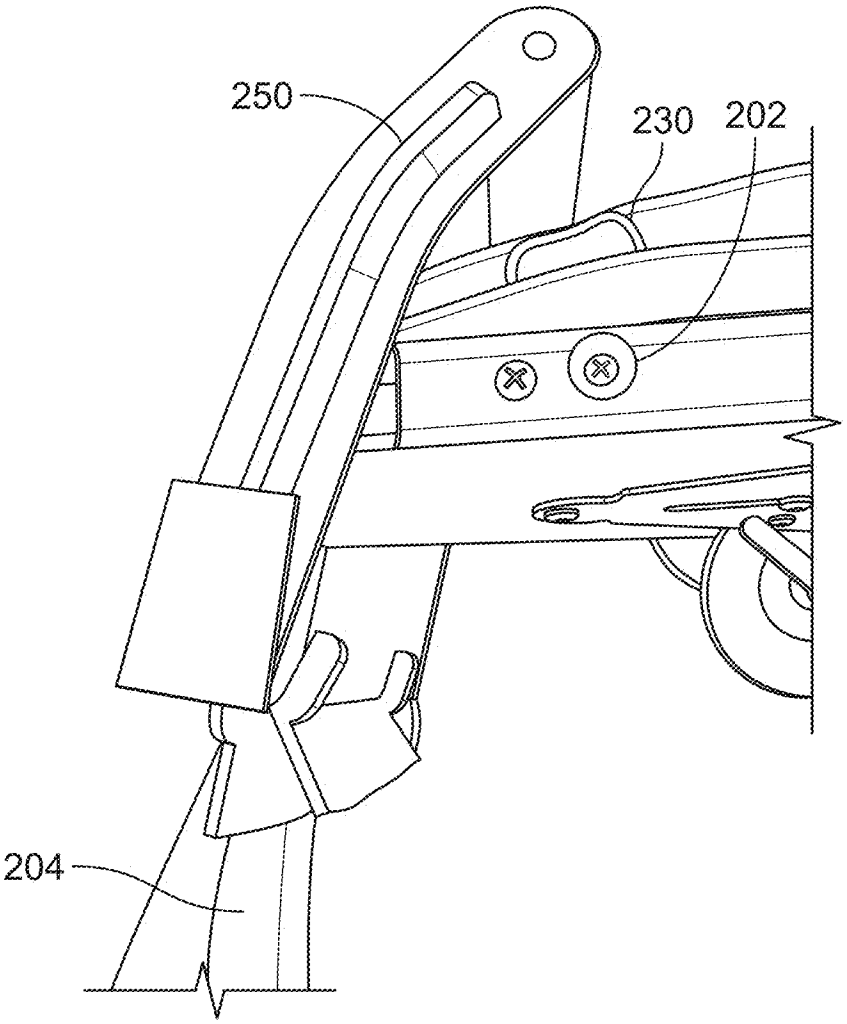
FIGS. 15A and 15B show a detailed view of a pedal mechanism in accordance with yet another embodiment.
Figure 15A:
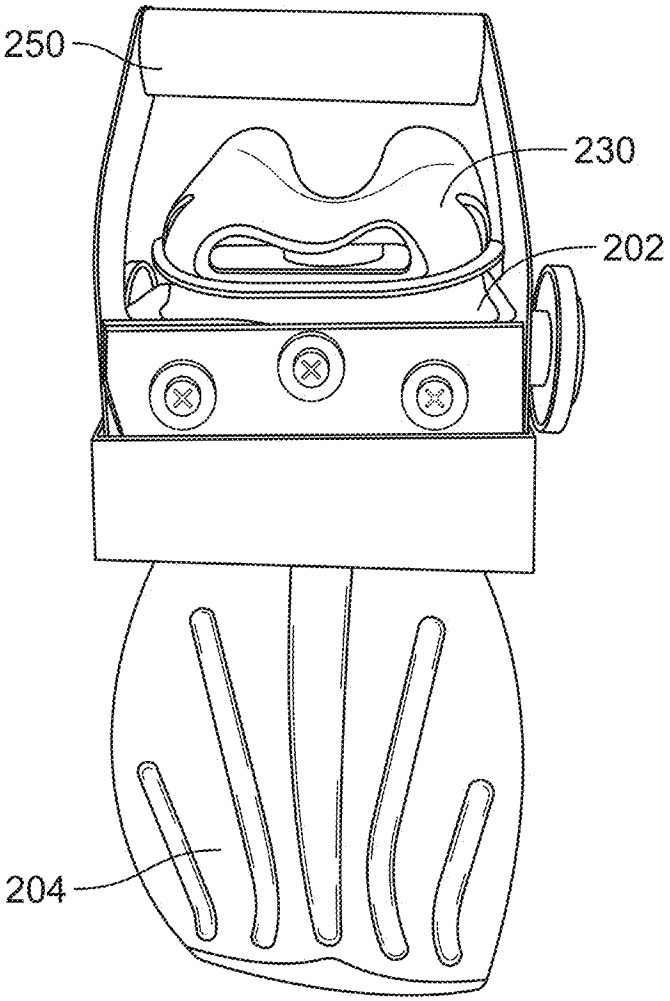

FIGS. 15A and 15B show yet another embodiment of the pedal mechanism, in which the paddle 204 is attached to pedal 202 by a two-way hinge, and has a bracket 250 extending above the pedal 202. Bracket 250 may be used to shift the paddle 204 into forward or reverse by engaging either a front brace 251 or a back brace 252, in order to allow the user to move the watercraft forward or backward. In this illustrative embodiment, the bracket 250 is a switch mechanism adapted to allow the two-way hinge to bend either backwards or forwards.

Figure 16A:
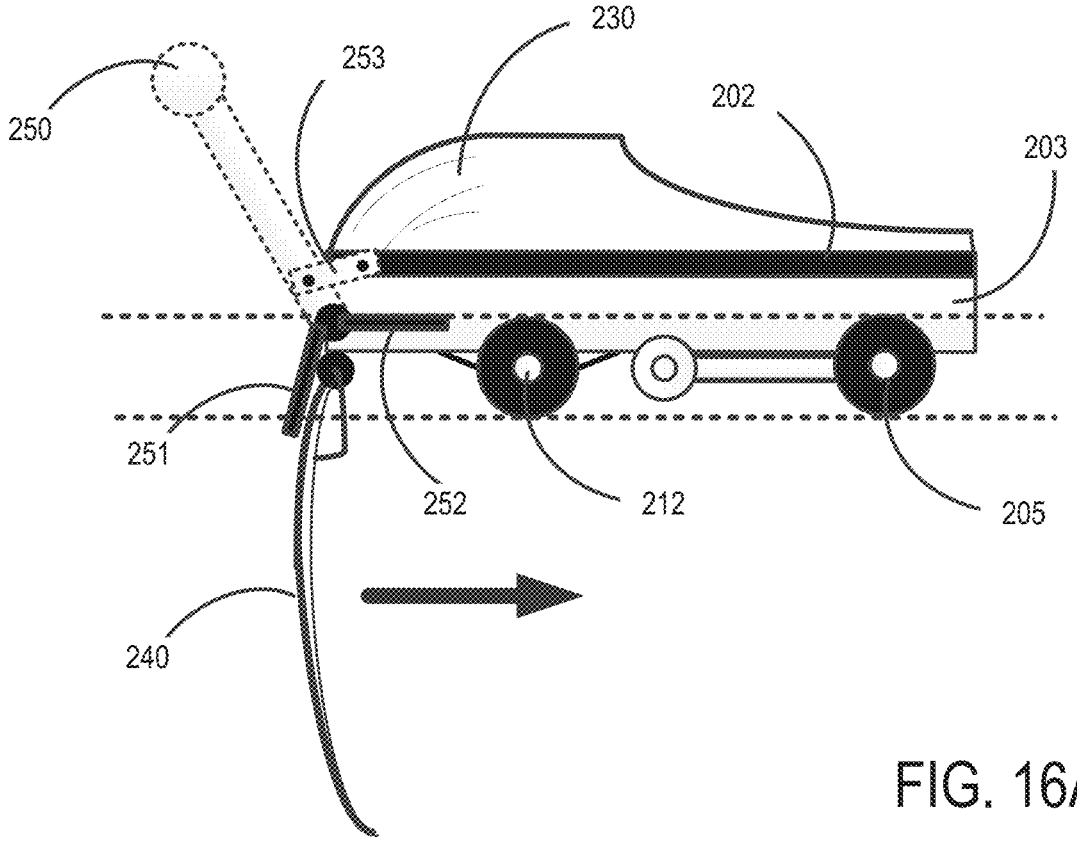
FIGS. 16A-16B show schematic side views of a pedal mechanism in accordance with another embodiment.
Figure 16B:
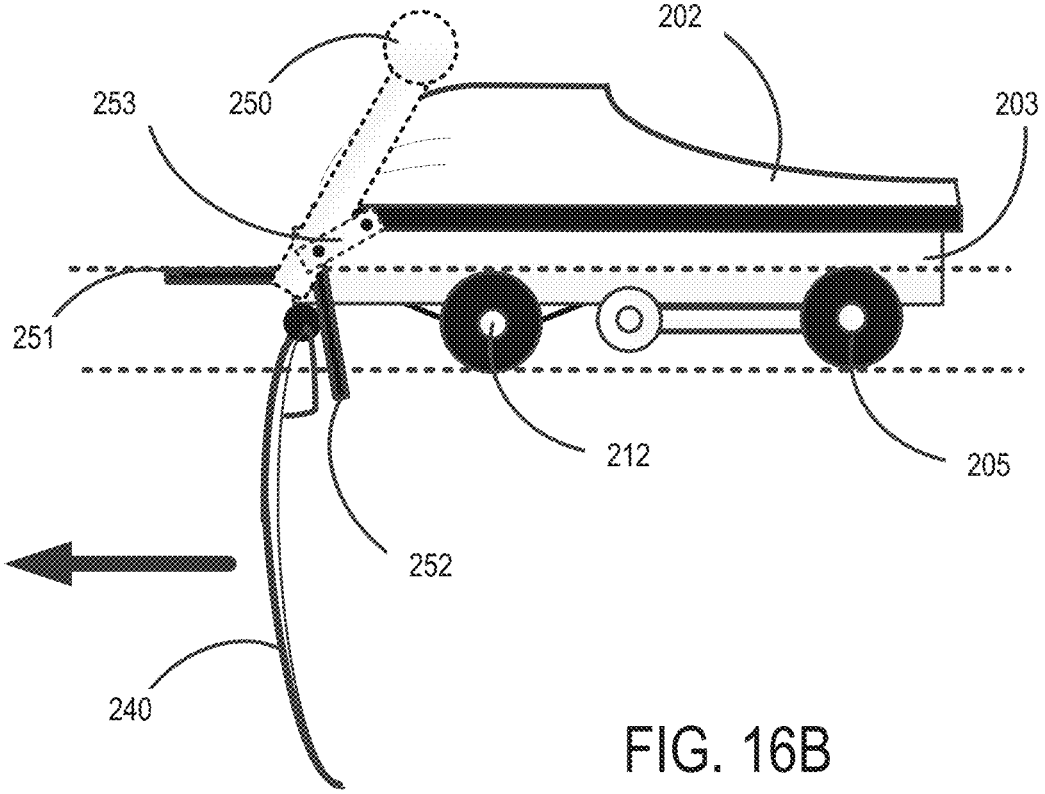
Figure 17:
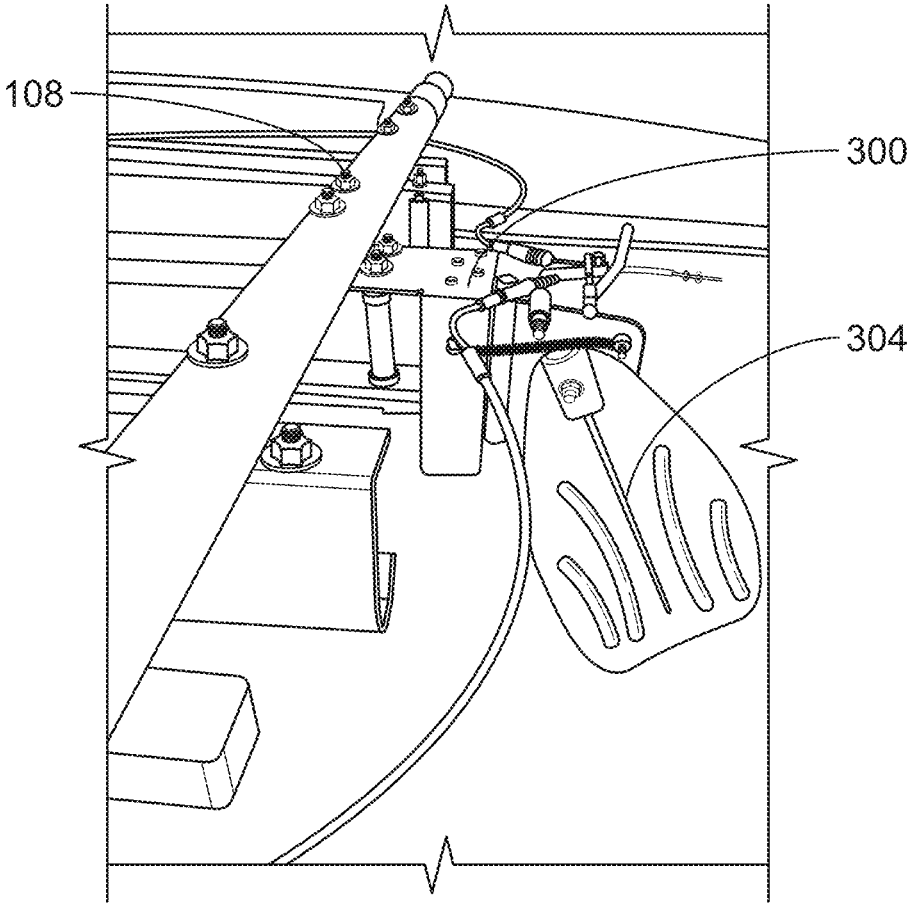
FIGS. 17 to 20 show a watercraft steering mechanism in accordance with an embodiment.

As best illustrated in FIGS. 16A and 16B, in forward mode, front brace 251 is engaged and bracket 250 bends backwards at the two-way hinge on a forward movement, and engage the water during a backward movement to allow forward motion of the watercraft 100. In reverse mode, with the back brace 252 engaged, bracket 250 can only bend forwards at the two-way hinge on a backwards movement, and engage the water during a forward movement to allow a rearward movement of the watercraft 100.

In another embodiment, instead of a bracket 250, the switch mechanism for selecting forward or reverse is instead a small cog, pin or ratchet 253 attached to the front toe portion of the pedal 202. In use, the user lifts the toe portion of the rubber boot 230 and pedal 202 which is it in contact with the base 203, and moves the rubber boot 230 and pedal 202 forwards or backwards slightly relative to the base 203 to trigger either the back brace 252 or front brace 251 to engage the paddle 204. This allows the user to shift into forward or reverse without bending down.

In an embodiment, in order to allow the paddle 204 to operate either in forward or reverse, the paddle 204 is hinged with a spring which tends to return the paddle 204 generally to a perpendicular position relative to the pedal. This helps to set the paddle 204 up for the next stroke more quickly.

Now referring to FIGS. 17 to 20, shown is a watercraft steering mechanism 300 in accordance with an embodiment. Steering mechanism 300 is attached to rear cross bracket 108 which secures pontoons 102 and 104 together. Steering mechanism 300 includes a pivotally mounted rudder or steering fin 304 which is controlled by way of control cables 306, 308.

Figure 18:
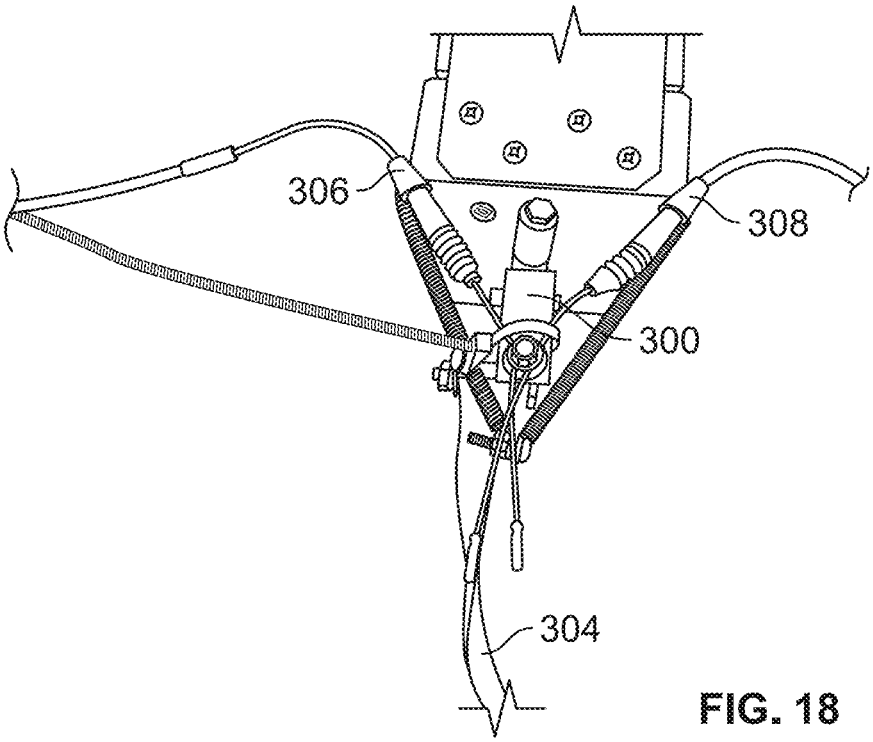
Figure 19:
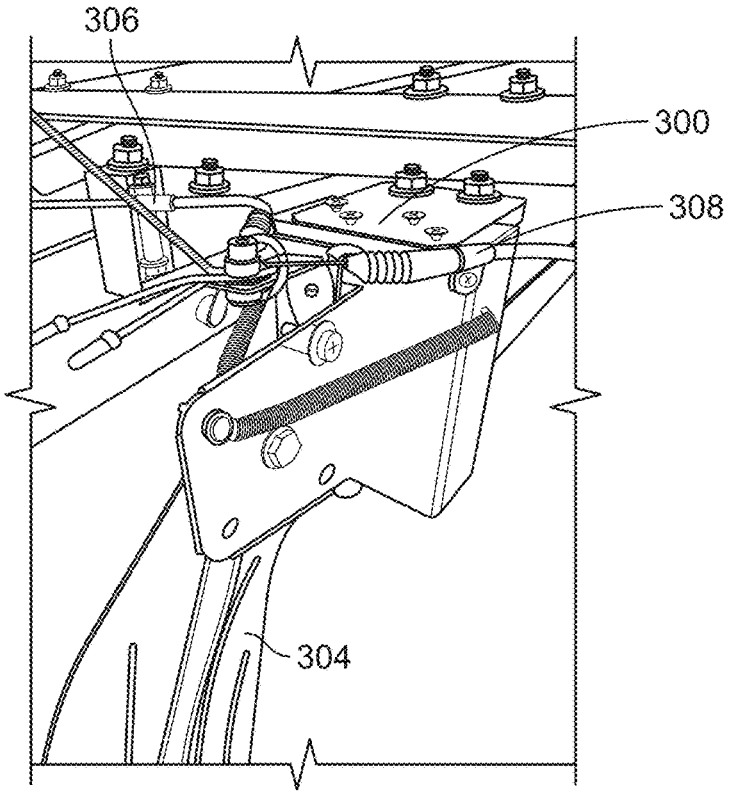
Figure 20:
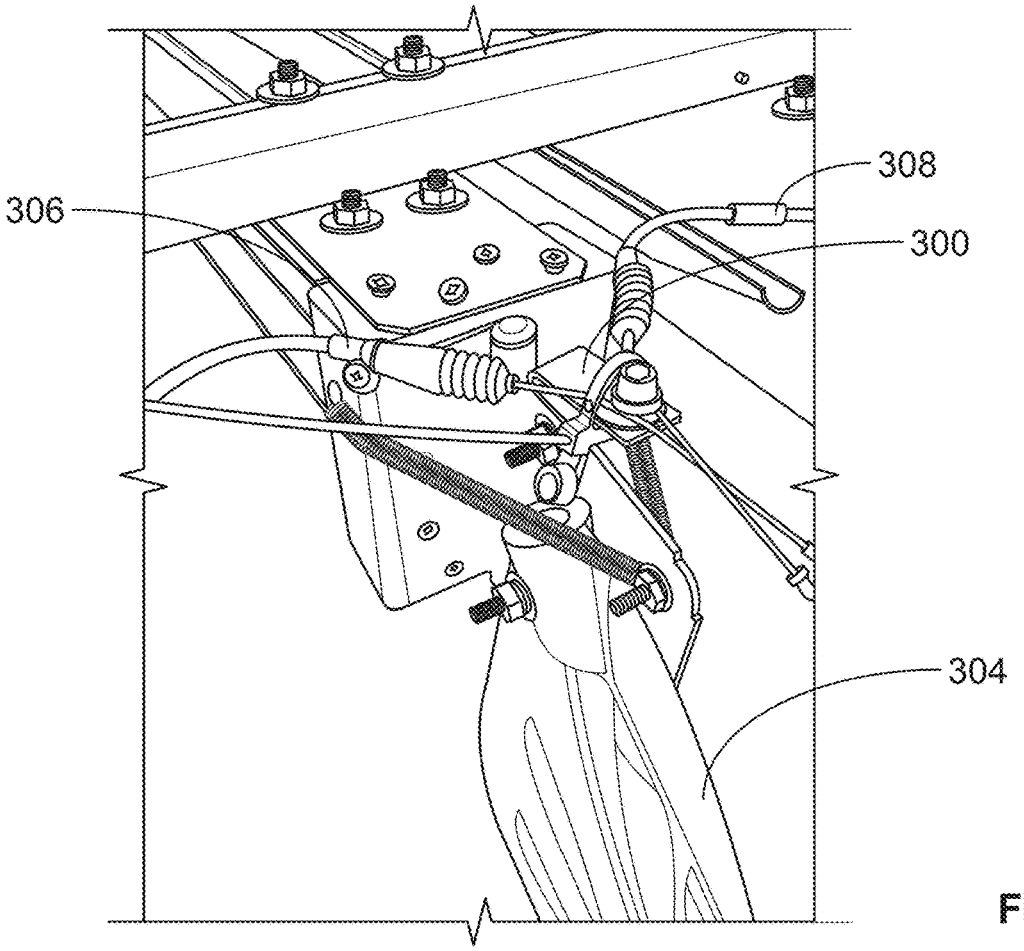
Figure 22:
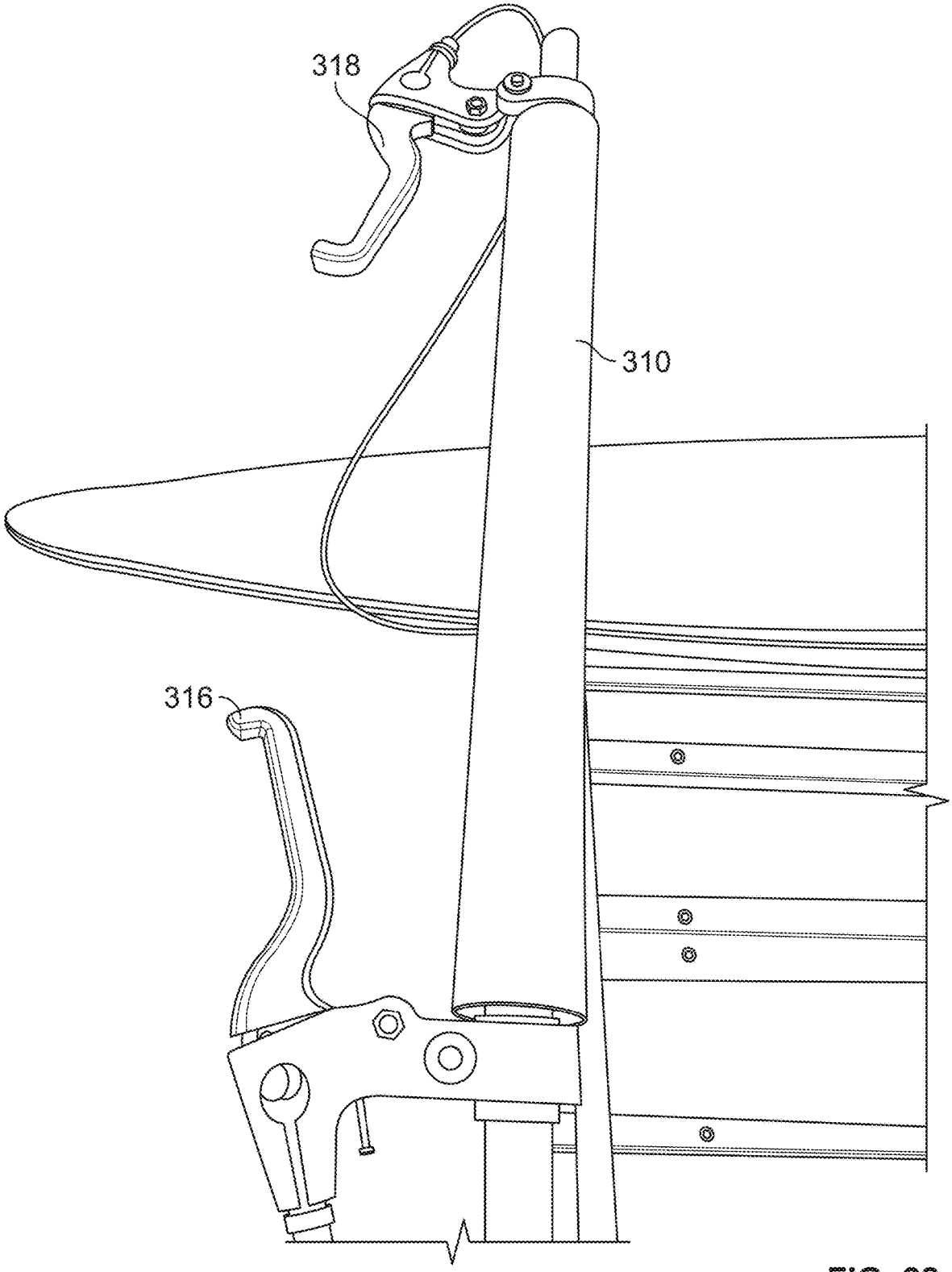
FIG. 22 shows a detailed view of the steering mechanism in accordance with an embodiment.

Referring to FIGS. 18 to 20, control cables 306, 208 are operatively connected at their opposite ends to a handle 310, for example to steering mechanisms 316, 318 which are manually operable to allow a user of the watercraft 100 move the rudder 304 to steer the watercraft 100. FIG. 22 shows a detailed view of the steering mechanisms 318, 218 in accordance with an embodiment. The steering mechanism is in a few diagrams and it shows two brake type levers on both sides of the top part of the padded handlebar. These two brake type levers are attached to brake lines that run to the back of the sliding rails and attach in the middle of the rear portion. The rudder is attached to the rear part of the watercraft 100 by brackets and a "hinge" type mechanism that allows the rudder to move from side to side. This hinge type mechanism will be spring loaded to keep it going straight forward until either the left or right steering lever in pressed.

This allows the glider to be steered when needed or go straight which happens most of the time. An alternative feature would be to have the steering levers incorporate a progressive ratchet mechanism that allows the user to press the steering lever once to the desired angle of turn and leave it, until the user wants go straight again, then fully pulls the lever down to release the ratchet and the turn. The rudder may be attached to the hinge bracket by one bolt that is loose enough to allow the rudder to move backwards and up when coming into contact with rocks or a sandy beach. The rudder may also have a spring attached to the mid-point of the rudder and the bottom of the hinge mechanism that allows the rudder to move up, but pull it back down when in clear water. This way the rudder may be lifted so that it does not become damaged.

Figure 21:
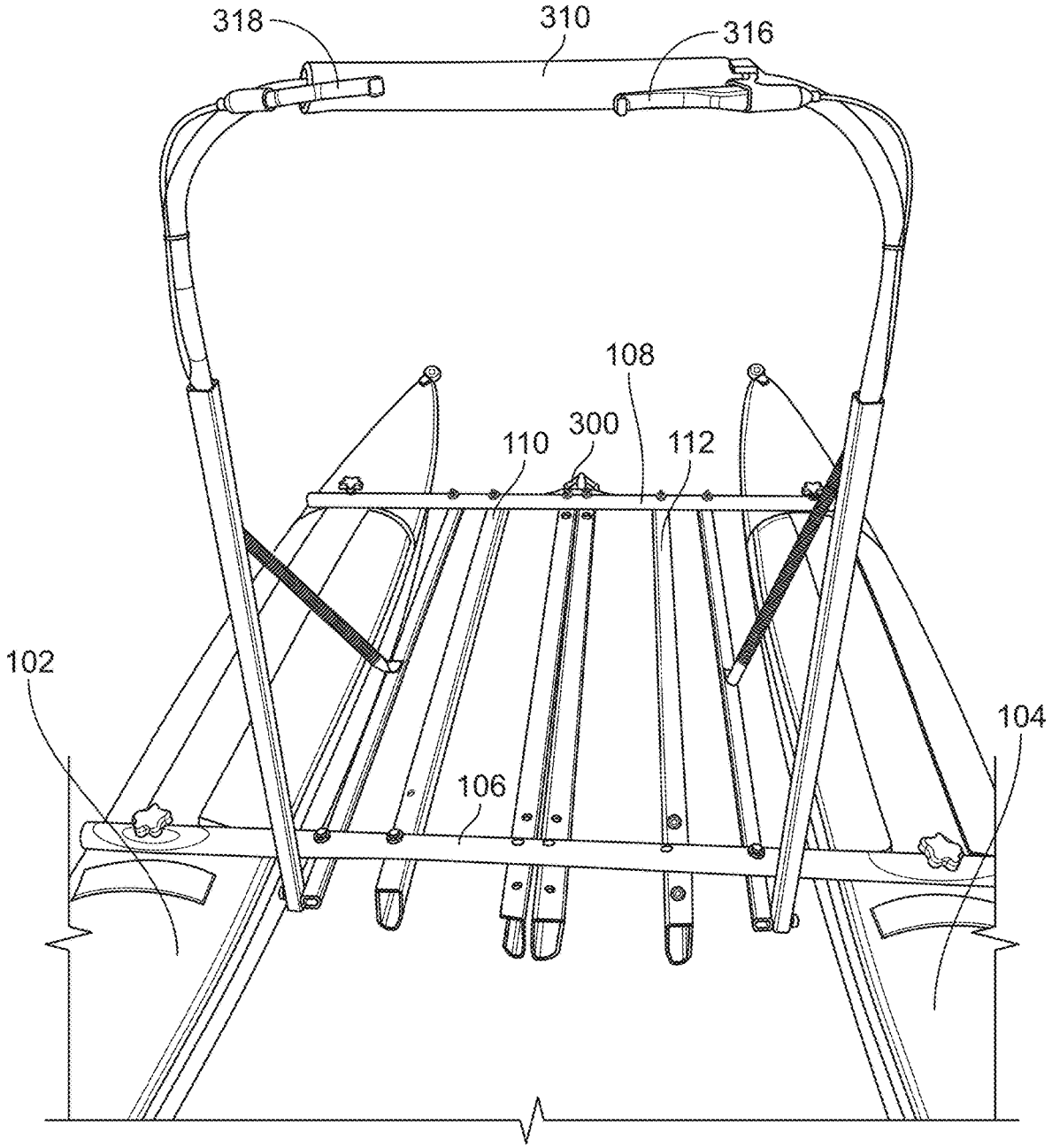
FIG. 21 shows an illustrative handle and steering mechanism in accordance with an embodiment.
Figure 23:
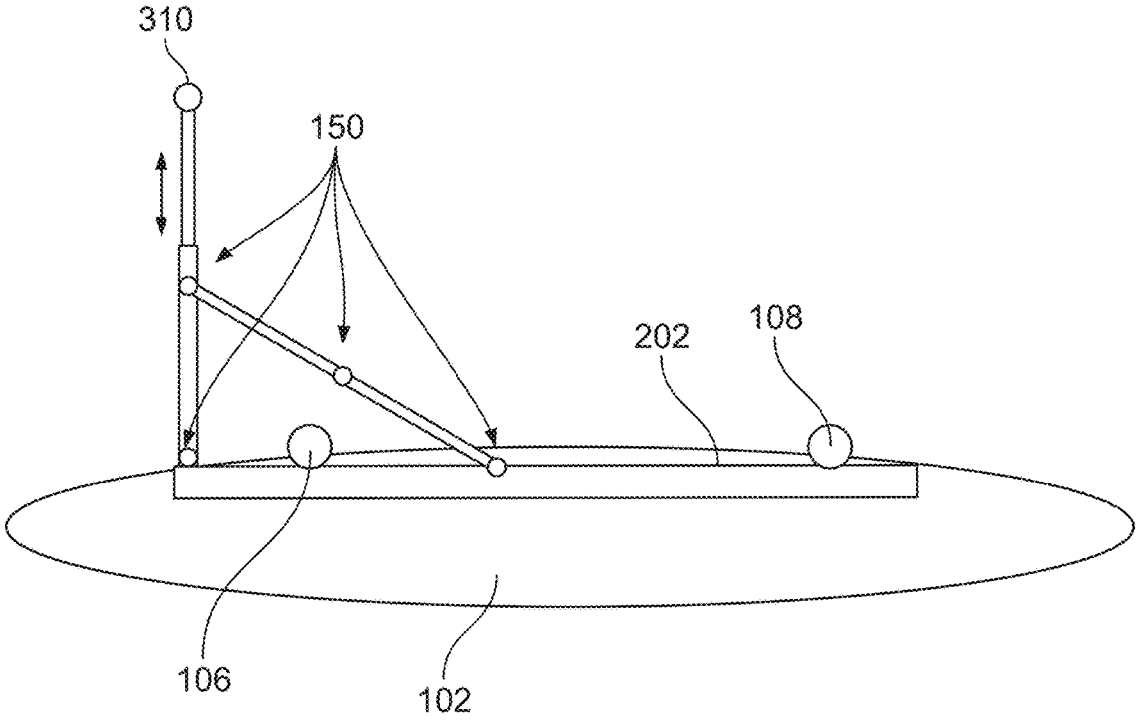
FIG. 23 shows a schematic view of the handle of FIGS. 21 and 22, which is foldable for storage.

FIG. 23 shows a schematic view of the handle of FIGS. 21 and 22, which is height adjustable, and foldable at joints 150 for more compact storage. The top portion of the handle slides into the bottom part of it, to adjust up and down. Removable pins can be used to adjust and secure the top handlebar at multiple locations, to best suit the user for his or her height and degree of pushing or pulling the user exerts on the handle bar. The bottom part of the handle bar is attached to the front crossbar or sliding rails on each side with a folding bracket to secure it to the frame properly, but also allow the whole handlebar assembly to fold flat on top of the sliding rails for transport. The bottom portion of the handlebar may also have a folding bracket on each side that attaches both to the handle bar and the side of each outside sliding rail, which folds so that the handlebar can again fold down for transport or storage. The handlebar may have foam padding for comfort since the user will be pushing hard against the handlebar with every leg stroke to the paddles.

Advantageously, as the user is able to use a full range of motion of the user's legs and feet in order to push the watercraft forward, the user is less likely to experience fatigue in a particular muscle area which may otherwise be placed under significant strain that the user is not used to.

Thus, in an aspect, there is provided a watercraft paddle apparatus operable by a user's legs and feet, comprising: a pair of rails positioned side-by-side and mountable to a watercraft, each rail configured to slidably receive a pedal mechanism adapted to slide back and forth along each rail; wherein each pedal mechanism includes a downwardly extendable paddle adapted to be lowered to engage a water surface on which the watercraft is floating during a backward stride, and to be lifted from the water surface on a forward stride; whereby a user can operate the pedal mechanism in each rail with the user's legs and feet, using an alternating walking or skiing motion.

In an embodiment, each pedal mechanism is supported laterally by a front axle with a pair of wheels on either end of the front axle engaging the rails.

In another embodiment, each pedal mechanism is attached, via a rotatable joint, to a rear axle with a pair of wheels on either end of the rear axle engaging the same rails as the front axle, whereby, the rotatable joint allows each pedal to be angled through a range of motion in order to support a user's foot throughout a stride.

In another embodiment, the paddle is rotatably hinged to a front end of the pedal mechanism.

In another embodiment, wherein the paddle is adapted to downwardly rotate to a fully extended position, and be held in that position for the backward stride.

In another embodiment, the hinge is spring loaded to lift the paddle from the water surface for the forward stride.

In another embodiment, the paddle is adapted to be lowered or lifted manually by the user.

In another embodiment, the pair of rails are parallel.

In another embodiment, the pair of rails are mountable to front and rear cross bars between a pair of pontoons.

In another aspect, there is provided a watercraft operable by a user's legs and feet, comprising: a pair of pontoons; and a pair of rails positioned side-by-side and mounted on cross bars between the pair of pontoons, each rail configured to slidably receive a pedal mechanism adapted to slide back and forth along each rail; wherein each pedal mechanism includes a downwardly extendable paddle adapted to be lowered between the pair of pontoons to engage a water surface on which the watercraft is floating during a backward stride, and to be lifted from the water surface on a forward stride; whereby a user can operate the watercraft using an alternating walking or skiing motion.

In an embodiment, each pedal mechanism is supported laterally by a front axle with a pair of wheels on either end of the front axle engaging the rails.

In another embodiment, each pedal mechanism is attached, via a rotatable joint, to a rear axle with a pair of wheels on either end of the rear axle engaging the same rails as the front axle, whereby, the rotatable joint allows each pedal to be angled through a range of motion in order to support a user's foot throughout a stride.

In another embodiment, the paddle is rotatably hinged to a front end of the pedal mechanism.

In another embodiment, the paddle is adapted to downwardly rotate to a fully extended position, and be held in that position for the backward stride.

In another embodiment, the hinge is spring loaded to lift the paddle from the water surface for the forward stride.

In another embodiment, the watercraft further comprises a switch mechanism for the paddle for selecting either a forward movement or a backward movement of the watercraft.

In another embodiment, the pair of rails are parallel.

In another embodiment, the watercraft further comprises a steering mechanism mounted to one of the cross bars, the steering mechanism including a rudder controlled by a pair of control wires.

In another embodiment, the pair of control wires are operatively connected to a steering wheel or handle.

In another embodiment, the steering wheel or handle is operable by the user of the watercraft.

While an illustrative embodiment has been shown and described, it will be appreciated that various changes and modifications may be made without departing from the scope of the invention, which is defined by the following claims.

The invention claimed is:

1. A watercraft paddle apparatus operable by a user's legs and feet, comprising:

a pair of rails positioned side-by-side and mountable to a watercraft, each rail configured to slidably receive a pedal mechanism adapted to slide back and forth along each rail;

wherein each pedal mechanism includes a downwardly extendable paddle adapted to be lowered to engage a water surface on which the watercraft is floating during a backward stride, and to be lifted from the water surface on a forward stride;

whereby a user can operate the pedal mechanism in each rail with the user's legs and feet, using an alternating walking or skiing motion, wherein each pedal mechanism is supported laterally by a front axle with a pair of wheels on either end of the front axle engaging the rails, and wherein each pedal mechanism is attached, via a rotatable joint, to a rear axle with a pair of wheels on either end of the rear axle engaging the same rails as the front axle, whereby, the rotatable joint allows each pedal to be angled through a range of motion in order to support a users foot throughout a stride.

2. The watercraft paddle apparatus of claim 1, wherein the paddle is rotatably hinged to a front end of the pedal mechanism.

3. The watercraft paddle apparatus of claim 2, wherein the paddle is adapted to downwardly rotate to a fully extended position, and be held in that position for the backward stride.

4. The watercraft paddle apparatus of claim 2, wherein the hinge is spring loaded to lift the paddle from the water surface for the forward stride.

5. The watercraft paddle apparatus of claim 2, wherein the paddle is adapted to be lowered or lifted manually by the user.

6. The watercraft paddle apparatus of claim 1, wherein the pair of rails are parallel.

7. The watercraft paddle apparatus of claim 6, wherein the pair of rails are mountable to front and rear cross bars between a pair of pontoons.

8. A watercraft operable by a users legs and feet, comprising:

a pair of pontoons; and a pair of rails positioned side-by-side and mounted on cross bars between the pair of pontoons, each rail configured to slidably receive a pedal mechanism adapted to slide back and forth along each rail;

wherein each pedal mechanism includes a downwardly extendable paddle adapted to be lowered between the pair of pontoons to engage a water surface on which the watercraft is floating during a backward stride, and to be lifted from the water surface on a forward stride;

whereby a user can operate the watercraft using an alternating walking or skiing motion, wherein each pedal mechanism is supported laterally by a front axle with a pair of wheels on either end of the front axle engaging the rails, and wherein each pedal mechanism is attached, via a rotatable joint, to a rear axle with a pair of wheels on either end of the rear axle engaging the same rails as the front axle, whereby, the rotatable joint allows each pedal to be angled through a range of motion in order to support a user's foot throughout a stride.

9. The watercraft of claim 8, wherein the paddle is rotatably hinged to a front end of the pedal mechanism.

10. The watercraft of claim 8, wherein the paddle is adapted to downwardly rotate to a fully extended position, and be held in that position for the backward stride.

11. The watercraft of claim 10, wherein the hinge is spring loaded to lift the paddle from the water surface for the forward stride.

12. The watercraft of claim 10, further comprising a switch mechanism for the paddle for selecting either a forward movement or a backward movement of the watercraft.

13. The watercraft of claim 8, wherein the pair of rails are parallel.

14. The watercraft of claim 8, further comprising a steering mechanism mounted to one of the cross bars, the steering mechanism including a rudder controlled by a pair of control wires.

15. The watercraft of claim 14, wherein the pair of control wires are operatively connected to a steering wheel or handle.

16. The watercraft of claim 15, wherein the steering wheel or handle is operable by the user of the watercraft.

* * * * *